US011521817B2

(12) United States Patent
Bausch et al.

(10) Patent No.: US 11,521,817 B2
(45) Date of Patent: Dec. 6, 2022

(54) SWITCHING DEVICE AND METHOD FOR OPERATING A SWITCHING DEVICE

(71) Applicant: Eaton Intelligent Power Limited, Dublin (IE)

(72) Inventors: Christoph Bausch, Bonn (DE); Lutz Friedrichsen, Dueren (DE); Volker Lang, Bonn (DE); Johannes Meissner, Bonn (DE); Julia Otte, Cologne (DE); Kai Schroeder, Niederkassel (DE)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/268,093

(22) PCT Filed: Aug. 13, 2019

(86) PCT No.: PCT/EP2019/071715
§ 371 (c)(1),
(2) Date: Feb. 12, 2021

(87) PCT Pub. No.: WO2020/035489
PCT Pub. Date: Feb. 20, 2020

(65) Prior Publication Data

US 2021/0304995 A1 Sep. 30, 2021

(30) Foreign Application Priority Data

Aug. 15, 2018 (GB) ..... 1813309

(51) Int. Cl.
*H01H 3/00* (2006.01)
*H01H 50/54* (2006.01)
(Continued)

(52) U.S. Cl.
CPC ..... *H01H 50/546* (2013.01); *H01H 33/08* (2013.01); *H01H 50/14* (2013.01); *H01H 50/18* (2013.01)

(58) Field of Classification Search
CPC ..... H01H 50/546; H01H 33/08; H01H 50/14; H01H 50/18; H01H 33/182; H01H 33/185;
(Continued)

(56) References Cited

U.S. PATENT DOCUMENTS 2,629,036 A 2/1953 Brown
5,241,290 A * 8/1993 Sehmer ..... H01H 71/56 335/185
5,877,464 A * 3/1999 Moldovan ..... H01H 9/443 335/201
(Continued)

FOREIGN PATENT DOCUMENTS

EP 2577699 B1 4/2013
EP 3349231 A1 7/2018

*Primary Examiner* — Shawki S Ismail
*Assistant Examiner* — Lisa N Homza
(74) *Attorney, Agent, or Firm* — Leydig, Voit & Mayer, Ltd.

(57) ABSTRACT

A switching device includes: a first terminal contact; a first fixed contact arranged at the first terminal contact; a contact bridge; a contact bridge carrier arranged at the contact bridge and having a barrier; a first movable contact arranged at the contact bridge; a second terminal contact; a second fixed contact arranged at the second terminal contact; a second movable contact arranged at the contact bridge; and a magnetic drive assembly including a coil and an armature, the armature being coupled to the contact bridge. The first fixed contact is in contact with the first movable contact in a switched-on state of the switching device. The first fixed contact is free of contact with the first movable contact in a switched-off state of the switching device. The second fixed
(Continued)

contact is in contact with the second movable contact in the switched-on state of the switching device.

18 Claims, 6 Drawing Sheets

(51) Int. Cl.
*H01H 33/08* (2006.01)
*H01H 50/14* (2006.01)
*H01H 50/18* (2006.01)

(58) Field of Classification Search
CPC ..... H01H 9/40; H01H 9/44; H01H 33/14; H01H 33/18; H01H 33/596; H01H 9/443; H01H 9/446; H01H 9/46; H01H 50/38; H01H 9/34; H01H 9/36; H01H 33/20
USPC ..... 335/185
See application file for complete search history.

(56) References Cited

U.S. PATENT DOCUMENTS 6,064,024 A * 5/2000 Moldovan ..... H01H 9/443 335/201
8,729,984 B2 * 5/2014 Feller ..... H01H 71/2463 335/184
9,947,489 B2 4/2018 Kralik
2009/0127229 A1 * 5/2009 Schmitz ..... H01H 9/36 218/22
2012/0306600 A1 * 12/2012 Feller ..... H01H 71/2463 335/38
2013/0206729 A1 * 8/2013 Lang ..... H01H 9/341 218/148
2013/0264310 A1 * 10/2013 Lang ..... H01H 9/346 218/2
2013/0264311 A1 * 10/2013 Lang ..... H01H 33/182 218/2
2013/0313228 A1 * 11/2013 Friedrichsen ..... H01H 1/20 218/23
2014/0263186 A1 * 9/2014 Gerving ..... H01H 33/182 218/26
2015/0091678 A1 * 4/2015 Xi ..... H01H 3/38 335/26
2015/0318133 A1 * 11/2015 Lauraire ..... H01H 50/14 335/185
2016/0217951 A1 7/2016 Kralik
2017/0345585 A1 * 11/2017 Lang ..... H01H 89/08
2018/0174789 A1 * 6/2018 Juelich ..... H01H 71/43

* cited by examiner

SWITCHING DEVICE AND METHOD FOR OPERATING A SWITCHING DEVICE

CROSS-REFERENCE TO PRIOR APPLICATIONS

This application is a U.S. National Phase application under 35 U.S.C. § 371 of International Application No. PCT/EP2019/071715, filed on Aug. 13, 2019, and claims benefit to British Patent Application No. GB 1813309.0, filed on Aug. 15, 2018. The International Application was published in English on Feb. 20, 2020 as WO 2020/035489 under PCT Article 21(2).

FIELD

The present disclosure is related to a switching device and a method for operating a switching device.

BACKGROUND

The switching device may be configured for switching DC currents, especially for switching higher DC currents. The switching device may be used in the field of electric mobility as well as in photovoltaic systems, battery storage systems or uninterruptible power supplies.

Additionally, a switching device may be required to switch off short-circuit currents, for example larger than 10 kA. Since a space is limited in an electric vehicle, the switching device should be realized in a compact form.

Document U.S. Pat. No. 6,064,024 A describes a magnetic enhanced arc extinguisher for switching assemblies having rotatable permanent magnets in housings mounted to fixed contacts. A contactor comprises two stationary contacts, two contact pads which are attached to the stationary contacts, a movable contact arm, two movable contacts at the movable contact arm and an electromagnetic solenoid with an armature. The stationary contact has a bended form. A load current that flows through the stationary contact, the contact pad, the movable contact and the movable contact arm has a U-form in the switched-on state.

Document EP 3349231 A1 refers to an electro-mechanic connector. The connector comprises two terminal contacts, two fixed contacts arranged at the terminal contacts, a contact bridge, two movable contacts arranged at the contact bridge and a magnetic drive assembly with an armature.

Document US 2016/0217951 A1 is related to a switching device with permanent-magnetic arc extinguishment. A contact bridge is disposed on a contact carrier made of electrically insulating material.

SUMMARY

In an embodiment, the present invention provides a switching device, comprising: a first terminal contact; a first fixed contact arranged at the first terminal contact; a contact bridge; a contact bridge carrier arranged at the contact bridge and comprises a barrier; a first movable contact arranged at the contact bridge; a second terminal contact; a second fixed contact arranged at the second terminal contact; a second movable contact arranged at the contact bridge; and a magnetic drive assembly comprising a coil and an armature, the armature being coupled to the contact bridge, wherein the first fixed contact is in contact with the first movable contact in a switched-on state of the switching device, wherein the first fixed contact is free of contact with the first movable contact in a switched-off state of the switching device, wherein the second fixed contact is in contact with the second movable contact in the switched-on state of the switching device, wherein the second fixed contact is free of contact with the second movable contact in the switched-off state of the switching device, wherein the first terminal contact has a bended form such that a load current that flows through the first terminal contact, the first fixed contact, the first movable contact, and the contact bridge has a U-formed path in the switched-on state, wherein the barrier is located between the first terminal contact and the second terminal contact, and wherein the switching device is a circuit breaker.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
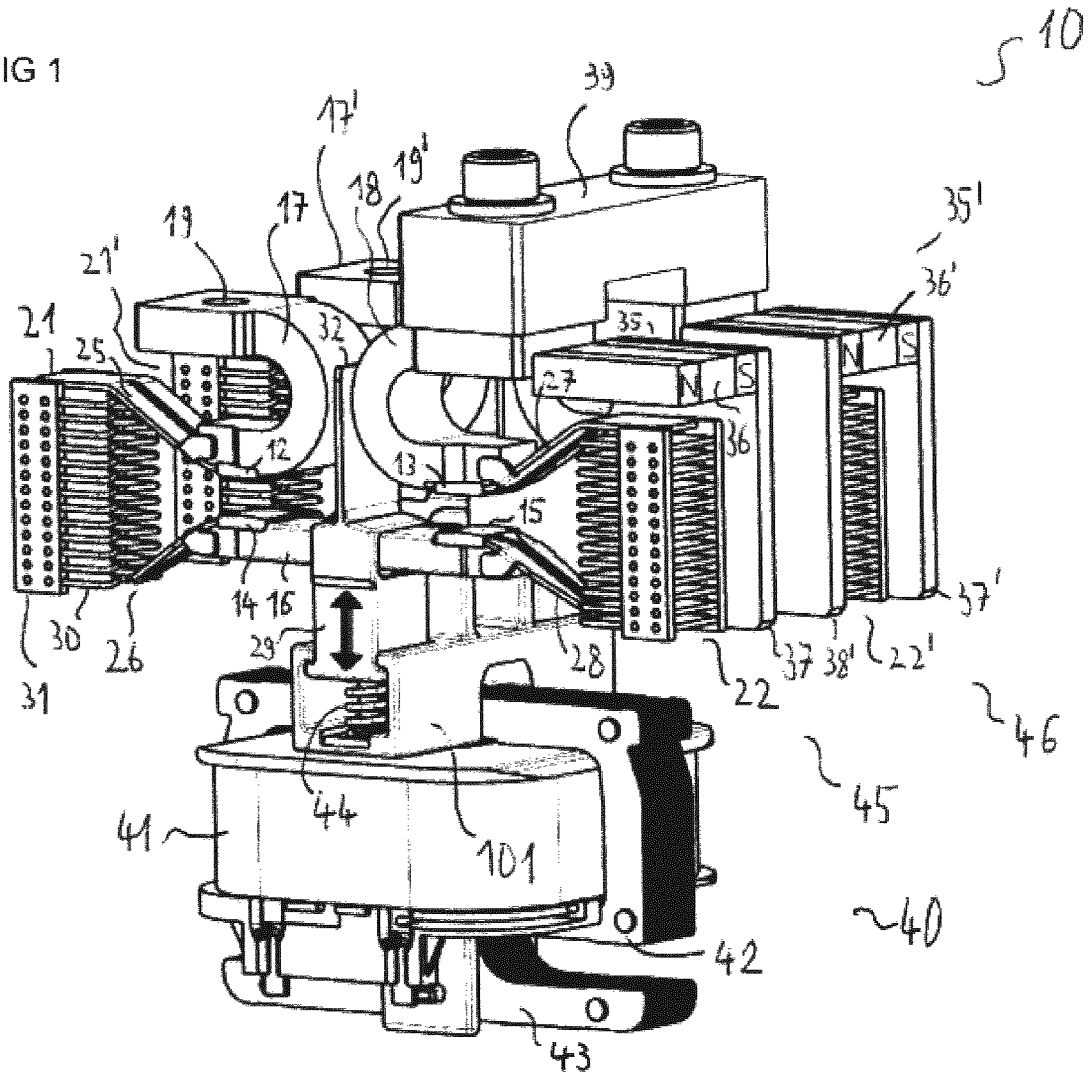
FIG. 1 shows an example of a switching device.

In an embodiment, the present invention provides a switching device and a method for operating a switching device that is able to operate with higher currents.

The definitions as described above also apply to the following description unless otherwise stated.

In an embodiment, a switching device comprises a first terminal contact, a first fixed contact arranged at the first terminal contact, a contact bridge and a first movable contact arranged at the contact bridge. The first fixed contact is in contact to the first movable contact in a switched-on state of the switching device. The first fixed contact is free of contact to the first movable contact in a switched-off state of the switching device.

In an embodiment, a load current that flows through the first terminal contact, the first fixed contact, the first movable contact and the contact bridge has a U-formed path in the switched-on state.

A first arc may be generated between the first fixed contact and the first movable contact at a transition between the switched-on state and the switched-off state of the switching device.

Advantageously, the U-form of the load current results in a magnetic field that drives the first arc away from the first fixed contact and the first movable contact. Thus, the switching device is able to switch off also very high currents. The U-form can be named U-shape.

In an embodiment, the first terminal contact has a bended form such that a load current that flows through the first terminal contact, the first fixed contact, the first movable contact and the contact bridge has the U-formed path in the switched-on state. U-formed can be named U-shaped. The first terminal contact may be extruded or milled. The first terminal contact may have the bended form directly after extrusion or milling. Alternatively, the first terminal contact may e.g. be made out a cuboid part which is bended into the bended form.

In an embodiment, the first terminal contact forms a first arm of the U-formed path. The contact bridge forms a second arm of the U-formed path. The first movable contact and the first fixed contact are part of the coupling of the first arm to the second arm.

In an embodiment, the load current that flows through the first terminal contact in the switched-on state has a path between an eighth and three-quarter of a circular line. Thus, a part of the first terminal contact may have a form between an eighth and three-quarter of a circular line.

In an embodiment, the load current that flows through the first terminal contact in the switched-on state has a path between a quarter and an half of a circular line. Thus, a part of the first terminal contact may have a form between a quarter and an half of a circular line.

In an embodiment, the path of the load current that flows through the first terminal contact first extends in a first direction and then in a second direction which has an angle of at least 45 degrees to the first direction. The angle may be at least 90 degrees. The angle may be at least 135 degrees.

In an embodiment, the path of the load current that flows through the first terminal contact between the first fixed contact and an area for connecting the first terminal contact from the outside of the switching device first extends in a first direction and then in a second direction which has an angle of at least 45 degrees to the first direction. The angle may be at least 90 degrees. The angle may be at least 135 degrees. The angle may be e.g. 180 degrees.

In an embodiment, the path of the load current that flows through the first terminal contact, the first fixed contact, the first movable contact and the contact bridge in the switched-on state extends or approximately extends in a first plane.

In an embodiment, the switching device comprises a cover. The first terminal contact may flush with the cover. The first terminal contact may not extend beyond the cover. The first terminal contact may be arranged in a recess of the cover.

In an embodiment, the switching device comprises a magnet core. The contact bridge may move away from the magnet core at a transition from the switched-off state to the switched-on state.

In an embodiment, a movement of the contact bridge between the switched-on state and the switched-off state has a direction that is parallel to the first plane.

The load current may be negative or positive. The load current may be e.g. a DC current.

In an embodiment, the switching device comprises a permanent magnet system comprising a first and a second pole plate and a permanent magnet that is arranged between the first pole plate and the second pole plate. The permanent magnet system generates a magnetic field perpendicular to the first plane.

In an embodiment, the first fixed contact and the first movable contact are between the first and the second pole plate in the switched-on state and in the switched-off state of the switching device.

In an embodiment, the switching device comprises a first arc runner arranged at the first terminal contact near the first fixed contact. The switching device may comprise a second arc runner arranged at the contact bridge near the first movable contact.

In an embodiment, the switching device comprises a first arc extinguishing device for extinguishing the first arc. The first arc extinguishing device may be connected to the first terminal contact and/or the first arc runner.

In an embodiment, the first terminal contact, the first arc generated between the first fixed contact and the first movable contact at a transition between the switched-on state and the switched-off state and the contact bridge form a first magnetic field loop that blows the first arc in the direction of the first arc extinguishing device. The load current that flows through the first terminal contact, the first arc and the contact bridge has the U-form, especially in a side view. The U-form of the load current generates the first magnetic field loop. A direction of movement of the contact bridge is perpendicular to the direction of the side view.

In an embodiment, the switching device comprises a second terminal contact, a second fixed contact arranged at the second terminal contact and a second movable contact arranged at the contact bridge. The second fixed contact is in contact to the second movable contact in the switched-on state of the switching device. The second fixed contact is free of contact to the second movable contact in the switched-off state of the switching device.

The second terminal contact may be realized such as the first terminal contact. The first and the second terminal contact may be symmetrical to a symmetry axis.

In an embodiment, the load current that flows through the contact bridge, the second movable contact, the second fixed contact and the second terminal contact has a further U-formed path in the switched-on state.

A second arc may be generated between the second fixed contact and the second movable contact at the transition between the switched-on state and the switched-off state of the switching device.

Advantageously, the further U-form of the load current results in a magnetic field that drives the second arc away from the second fixed contact and the second movable contact into a second arc extinguishing device. Thus, the switching device is able to switch off also very high currents.

In an embodiment, the second terminal contact has a bended form such that the load current that flows through the contact bridge, the second movable contact, the second fixed contact and the second terminal contact has the further U-formed path in the switched-on state. The second terminal contact may be fabricated such as the first terminal contact.

The second fixed contact and the second movable contact may be between the first and the second pole plate in the switched-on state and in the switched-off state of the switching device.

In an embodiment, the second terminal contact, the second arc generated between the second fixed contact and the second movable contact at a transition between the switched-on state and the switched-off state and the contact bridge form a second magnetic field loop that blows the second arc in the direction of the second arc extinguishing device. The load current that flows through the second terminal contact, the second arc and the contact bridge has the further U-form. The further U-form of the load current generates the second magnetic field loop. The first and the second magnetic field loop are coupled.

In an embodiment, the switching device comprises a contact bridge carrier which is arranged at the contact bridge. The contact bridge carrier may be rigidly attached or fixed to the contact bridge. The contact bridge carrier comprises a barrier. The barrier may be approximately perpendicular or perpendicular towards the contact bridge. The barrier is located between the first and the second terminal contact. The barrier moves together with the contact bridge. Advantageously, the barrier separates the first arc from the second arc in every state, such as e.g. in the switched-off state, the switched-on state and during a dynamic lift-off of the contact bridge. The contact bridge carrier and the contact bridge can be realized in a switching device independent of the form of the first and the second terminal contact.

Advantageously, the barrier may be inserted between the vertex of the U-form of the first terminal contact and the vertex of the U-form of second terminal contact. The smallest distance between the first and the second terminal contact may be between these two vertices.

In an embodiment, the contact bridge is realized as a cuboid or approximately as a cuboid.

In an embodiment, the switching device further comprises a further first terminal contact, a further first fixed contact arranged at the further first terminal contact, a further second terminal contact, a further second fixed contact arranged at the further second terminal contact, a further contact bridge and a further first and a further second movable contact that are arranged at the further contact bridge.

The contact bridge and the further contact bridge are operated in parallel, e.g. are moved simultaneously.

In an embodiment, the further first fixed contact is in contact to the further first movable contact and the further second fixed contact is in contact to the further second movable contact in the switched-on state of the switching device.

In an embodiment, the further first fixed contact is free of contact to the further first movable contact and the further second fixed contact is free of contact to the further second movable contact in the switched-off state of the switching device.

In an embodiment, the switching device is configurable as or operable for a separate circuit of the contact bridge and the further contact bridge, for a series circuit of the contact bridge and the further contact bridge and for a parallel circuit of the contact bridge and the further contact bridge.

In an embodiment, for the realization of the series circuit, the switching device further comprises a terminal connecting bridge electrically coupling the second terminal contact to the further second terminal contact. Thus, the first terminal contact is electrically connected to the further first terminal contact via the contact bridge and the further contact bridge in the switched-on state of the switching device. A first terminal lead may be connected to the first terminal contact and a second terminal lead may be connected to the further first terminal contact. Thus, the switching device can operate at high voltage.

In an embodiment, for the realization of the parallel circuit, the switching device comprises a further terminal connecting bridge electrically coupling the first terminal contact to the further first terminal contact. The first terminal lead may be connected to the terminal connecting bridge and the second terminal lead may be connected to the further terminal connecting bridge. Thus, the switching device can carry a high load current.

In an embodiment, for the realization of the separate circuit of the contact bridge and the further contact bridge, four terminal leads are connected to the first, the further first, the second and the further second terminal contact. The switching device is implemented as two-pole switching device and can switch two load currents at one point of time.

The terminal leads are connected from the outside to the switching device. A terminal lead can be realized as connection line, busbar or power cable.

The switching device may be configured such that the terminal connecting bridge and/or the further terminal connecting bridge are outside of the cover of the switching device. They can be inserted after fabrication of the switching device such as at the site of installation of the switching device.

In an embodiment, in the switched-off state, the load current that flows through the first terminal contact, the first fixed contact, the first arc, the first movable contact and the contact bridge has a U-form.

The switching device may be part of an electric vehicle and/or hybrid vehicle. The switching device may be realized as a contactor or circuit breaker, switching in air or encapsulated.

The switching device is configured to switch the load current at a high voltage. A high voltage may be any voltage above 42 V, above 72 V, above 110 V, above 220 V, above 300 V, above 360 V, above 500 V and/or above 1000 V. A nominal value of the load current of the switching device may be above 20 A, 30 A, 100 A, 200 A or 500 A. A nominal value of overcurrent of the switching device may be above 1 kA, 1.5 kA, 3 kA, 6 kA or 10 kA.

In an embodiment, a method for operating a switching device comprises bringing a first fixed contact in contact to a first movable contact in a switched-on state of the switching device, and bringing the first fixed contact out of contact to the first movable contact in a switched-off state of the switching device.

In an embodiment, a load current that flows through the first terminal contact, the first fixed contact, the first movable contact and the contact bridge has a U-formed path in the switched-on state. The load current that flows through the first terminal contact, the first fixed contact, the first arc, the first movable contact and the contact bridge has a U-formed path in the switched-off state. The first fixed contact is arranged at a first terminal contact. The first movable contact is arranged at a contact bridge.

In an embodiment, the first terminal contact is bended such that a load current that flows through the first terminal contact, the first fixed contact, the first movable contact and the contact bridge has the U-formed path in the switched-on state.

Thus, the first terminal contact is bended such that a load current that flows through the first terminal contact, the first fixed contact, a first arc, the first movable contact and the contact bridge has a U-formed path in the switched-off state. The first arc is between the first fixed contact and the first movable contact.

The method for operating a switching device may be implemented e.g. by the switching device according to one of the embodiments defined above.

FIG. 1 shows an example of a switching device 10. The switching device 10 realizes a remote controlled circuit breaker function. The switching device 10 comprises an enclosing housing (shown in FIG. 2K). The switching device 10 comprises a first fixed contact 12, a first movable contact 14, a contact bridge 16 and a first terminal contact 17. The contact bridge 16 may be called "switching bridge". The first movable contact 14 is fixed on the contact bridge 16. The first fixed contact 12 is fixed on the first terminal contact 17.

Moreover, the switching device 10 comprises a second fixed contact 13, a second movable contact 15 and a second terminal contact 18. The second fixed contact 13 is fixed on the second terminal contact 18. Moreover, the second movable contact 15 is fixed on the contact bridge 16. The contact bridge 16 is realized as a cuboid. The contact bridge 16 may be made of copper. The first and the second fixed contact 12, 13 may also be called "fixed contact tip". The first and the second movable contact 14, 15 may also be called "movable contact tip". The first and the second fixed contact 12, 13 may be made of AgSnO2 or AgZnO. Also the first and the second movable contact 15, 16 may be made of AgSnO2 or AgZnO.

The first terminal contact 17 has a bended form. The first terminal contact 17 has a U-form. In an example the first terminal contact 17 may be fabricated by bending a cuboid into a U-form. The second terminal contact 18 is realized such as the first terminal contact 17. The first and the second terminal contacts 17, 18 can be made of copper. The first and the second terminal contact 17, 18 each comprises a terminal connection hole 19, 20.

The switching device 10 comprises a first arc runner 25 connected to the first terminal contact 17. Moreover, the switching device 10 comprises a second arc runner 26 connected to the contact bridge 16. The first arc runner 25 is attached to the first terminal contact 17 in vicinity of the first fixed contact 12. The second arc runner 26 is attached to the contact bridge 16 in vicinity of the first movable contact 14.

Additionally, the switching device 10 comprises a third arc runner 27 connected to the second terminal contact 18. Moreover, the switching device 10 comprises a fourth arc runner 28 connected to the contact bridge 16. The arc runners may be made of bronze, such as CnSn6, Cu or CuZn.

A first arc extinguishing device 21 is connected to the first arc runner 25. The first arc extinguishing device 21 comprises a number of splitter plates 30 that are arranged in a core 31. The core 31 holds the splitter plates 30 and is connected to the first terminal contact 17. The core 31 is realized as arcing chamber side wall or walls. The splitter plates 30 are made of stainless steel or copper. A second arc extinguishing device 22 is connected to the third arc runner 27.

The switching device 10 comprises a contact bridge carrier 29. The contact bridge carrier 29 may be of plastics such as a polyetheretherketon, abbreviated as PEEK. The contact bridge 16 is inserted into the contact bridge carrier 29. Moreover, the contact bridge carrier 29 comprises a barrier 32 that is arranged in the space between the first and the second terminal contact 17, 18. The barrier 32 is free of a contact to the first and to the second terminal contact 17, 18. The barrier 32 has the form of a plate. The barrier 32 is also realized from a plastics material such as e.g. PEEK. The contact bridge carrier 29 and the barrier 32 are fabricated as one part. Thus, the contact bridge carrier 29 and the barrier 32 are made out of one identical material.

Moreover, the switching device 10 comprises a permanent magnet system 35 having a permanent magnet 36 and a first and a second pole plate 37, 38. The second pole plate 38 is not shown in FIG. 1. The contact bridge 16, the first and the second terminal contact 17, 18 and the first and the second arc extinguishing device 21, 22 are arranged between the first and the second pole plates 37, 38. The permanent magnet 36 may be realized as rare earth magnet and may be e.g. neodymium-based. The first and the second pole plate 37, 38 may be made of steel.

Moreover, the switching device 10 comprises a magnetic drive assembly 40. The magnetic drive assembly 40 comprises a coil 41. Moreover, the magnetic drive assembly 40 comprises a magnet core 42 which holds the coil 41. Additionally, the magnetic drive assembly 40 comprises an armature 43. Moreover, the switching device 10 comprises a bridge 101. The bridge 101 passes through the coil 41. The armature 43 is coupled to the bridge 101. The armature 43 is fastened to the bridge 101. The bridge 101 encloses the magnet core 42 and the armature 43. The switching device 10 comprises a contact spring 44 that couples the armature 43 via the bridge 101 to the contact bridge carrier 29. Thus, the armature 43 is not fastened to the contact bridge carrier 29 and to the contact bridge 16. The armature 43 is coupled via the contact spring 44 to the contact bridge carrier 29 and thus to the contact bridge 16. This arrangement is shown in detail in FIG. 2A. The contact spring 44 may be made of steel such as inox steel.

The contact bridge 16 and the first and the second terminal contact 17, 18 are part of a first switching chamber 45 of the switching device 10. The first switching chamber 45 comprises the first and the second arc extinguishing device 21, 22 and the arc runners 25 to 28.

Moreover, the switching device 10 comprises a second switching chamber 46 that is realized such as the first switching chamber 45. Thus, the switching device 10 comprises a further contact bridge 16', a further first and second terminal contact 17', 18', a further first and second fixed contact 12', 13' and a further first and second movable contact 14', 15'. The switching device 10 comprises a further first and second arc extinguishing device 21', 22' and arc runners 25' to 28'. The switching device 10 comprises a further permanent magnet system 35' having a further permanent magnet 36' and a further first and second pole plate 37', 38'. The further contact bridge 16', the further first and second terminal contact 17', 18' etc. are part of the second switching chamber 46.

The switching device 10 comprises a terminal connecting bridge 39. The terminal connecting bridge 39 electrically couples the first switching chamber 45 to the second switching chamber 46. The terminal connecting bridge 39 electrically connects the second terminal contact 18 to the further second terminal contact 18'. Thus, the terminal connecting bridge 39 is inserted into the second terminal connection hole 20 and a further second terminal connection hole 20' which is hidden in FIG. 1. The terminal connecting bridge 39 made be made of copper. The magnetic drive assembly 40 is also coupled via the bridge 101, the contact spring 44, a pin 102 (shown in FIG. 2A) and the contact bridge carrier 29 to the further contact bridge 16'.

The switching device 10 is configured to be set in a switched-on state or a switched-off state. The switched-off state is shown in FIG. 1. In the switched-off state, the first fixed contact 12 is not in contact with the first movable contact 14. Correspondingly, the second fixed contact 13 is not in contact with the second movable contact 15. Thus, a flow of a load current I from the first terminal contact 17 to the second terminal contact 18 via the contact bridge 16 is inhibited.

The switching device 10 is set from the switched-off state into the switched-on state by a movement of the contact bridge 16 in a direction perpendicular to the contact bridge 16. The magnetic drive assembly 40, as shown in FIGS. 1 and 2A, moves the contact bridge 16 via the bridge 101 and the contact spring 44 towards the first and the second terminal contact 17, 18. In the switched-on state, the first fixed contact 12 is in contact to the first movable contact 14 and the second fixed contact 13 is in contact to the second movable contact 15. Thus, a load current I can flow from the first terminal contact 17 via the first fixed contact 12, the first movable contact 14, the contact bridge 16, the second movable contact 15 and the second fixed contact 13 to the second terminal contact 18.

The switching device 10 is set from the switched-on state into the switched-off state by a movement of the contact bridge 16 that separates the contact bridge 16 from the first and the second terminal contact 17, 18. In case of a load current I flowing before switching, a first arc 23 may be generated between the first fixed contact 12 and the first movable contact 14 and a second arc 24 may be generated between the second movable contact 15 and the second fixed contact 13.

The load current I that flows through the first terminal contact 17 has a curved or bended path. The load current I has a U-formed or U-shaped path. Correspondingly, the load current I that flows through the second terminal contact 18 also has a curved or bended path. The load current I in the second terminal contact 17 has a further U-formed path. The opening of the U-formed path is directed towards the opening of the further U-formed path.

In FIG. 1, the switching device 10 comprises two electrical serially coupled switching chambers 45, 46. The extinguishing of the arcs is further explained with FIGS. 2A to 2G.

FIG. 2A shows an example of a cross-section of the contact bridge 16, the contact bridge carrier 29 and the magnetic drive assembly 40 of the example shown in FIG. 1. The barrier 32 is perpendicular or approximately perpendicular to the contact bridge 16. The contact bridge 16 is fixed into the contact bridge carrier 29. However, the contact bridge carrier 29 is movable with respect to the armature 43. The contact spring 44 is arranged between the armature 43 and the contact bridge 16. The contact spring 44 presses the contact bridge 16 in the direction of the first and second terminal contact 17, 18. A pin 102 or bolt is attached to an end of the contact spring 44. The pin 102 is directed towards the contact bridge 16. Thus, the pin 102 is directed towards a notch 108 of the contact bridge 16. The contact spring 44 and the pin 102 are arranged between the contact bridge 16 and the bridge 101 and thus between the contact bridge 16 and the armature 43. At the transition between the switched-on state to the switched-off state, the armature 43 pulls the bridge 101, the contact bridge carrier 29 and the contact bridge 16 away from the first and the second terminal contact 17, 18. In FIG. 2A, the magnetic drive assembly 40 is shorted in the direction of switching. The magnetic drive assembly 40 is connected to the contact bridge 16. The barrier 32 is realized as an arc barrier or arc barrier plate. Thus, the contact bridge 16 is held in an exact position by the contact spring 44 and the pin 102.

Figure 2B:
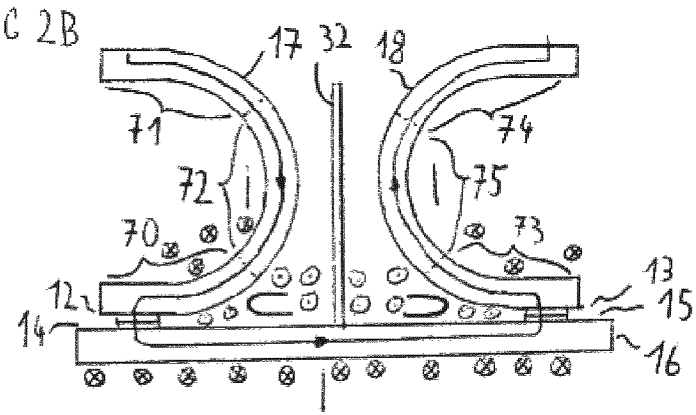
FIGS. 2A to 2K show examples of details of a switching device.
Figure 2C:
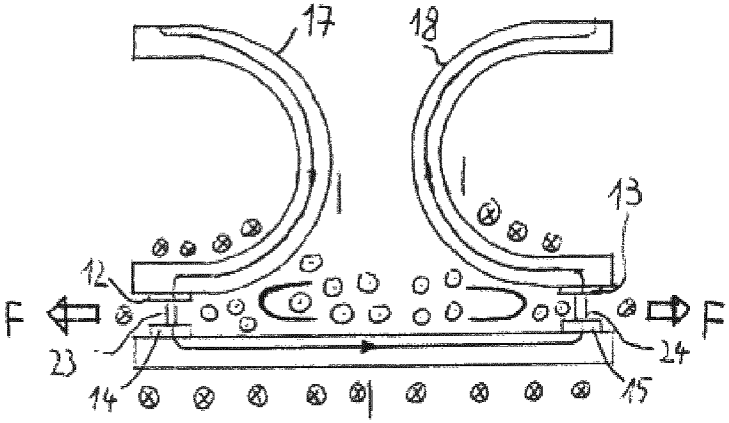
Figure 2A:
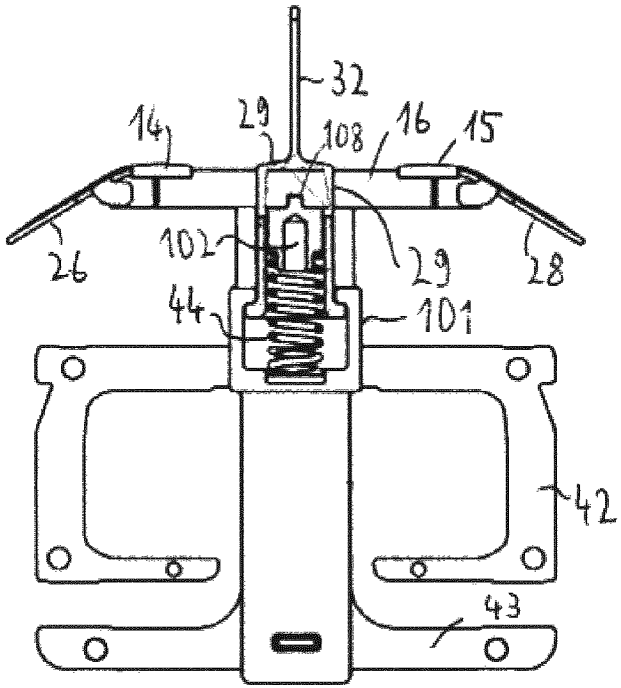

FIG. 2B shows an example of the contact bridge 16 and the first and the second terminal contact 17, 18 shown in FIGS. 1 and 2A in a cross-section in the switched-on state of the switching device 10. Some parts are omitted to better show the relevant steps. The first terminal contact 17 has a first arm 70, a second arm 71 and a connecting part 72. The connecting part 72 connects the first arm 70 to the second arm 71. The first terminal contact 17 has the form of a semicircle or comprises a part having the form of a semicircle. The first arm 70 has a main direction that is approximately parallel to a main direction of the contact bridge 16. Thus, the load current I that flows through the first arm 70 of the first terminal contact 17, the first fixed contact 12, the first movable contact 14 and the terminal bridge 16 has a U-form or U-shape.

The second terminal contact 18 has a further first arm 73, a further second arm 74 and a further connecting part 75. The second terminal contact 18 has the form of a semicircle or comprises a part having the form of a semicircle. Additionally, the load current I that flows through the terminal contact 16, the second movable contact 15, the second fixed contact 13 and the further first arm 73 of the second terminal contact 18 has a further U-form or further U-shape. The connecting part 72 of the first terminal contact 17 is close to the further connecting part 75 of the second terminal contact 18. The U-form and the further U-form both "lie" on the contact bridge 16. The bottom of the U-form and the bottom of the further U-form are both directed to the barrier 32. The opening of the U-form has an opposite direction than the opening of the further U-form.

In case of a high value of the load current I such as in case of a short-circuit, the load current I generates a high magnetic field at the place of the first arc 23. This magnetic field is higher than a magnetic field generated by the permanent magnet system 35. The direction of the magnetic field is indicated by circles with a point where the magnetic field comes out of the plane of the figure. Correspondingly, the magnetic field is indicated as a circle with a cross at places where the magnetic field goes into the plane of the figure.

In the case that the load current I has a high value such as in the case of a short-circuit, the load current I in the first arm 70 of the first terminal contact 17 and in the bridge contact 16 generates a magnetic field at the place of the first fixed contact 12 and the first movable contact 14. Similarly, the load current I in the bridge contact 16 and in the first arm 73 of the second terminal contact 18 generates a magnetic field at the place of the second fixed contact 13 and the second movable contact 15.

The load current I that flows through the first terminal contact 17 in the switched-on state has a path of a half of a circular line. The path of the load current I that flows through the first terminal contact 17 first extends in a first direction and then in a second direction which has an angle $\alpha$ of 180 degrees to the first direction.

FIG. 2C shows the cross-section shown in FIG. 2B in the switched-off state, for example at the transition from the switched-on state to the switched-off state. In the case that the load current I has a high value such as in the case of a short-circuit, the load current I in the first arm 70 of the first terminal contact 17 and in the bridge contact 16 generates a magnetic field at the place of the first arc 23 such that the first arc 23 is driven into the first arc extinguishing device 21. The force F on the first arc 23 is the Lorentz-force. Thus, the first arc 23 is driven into the first arc extinguishing device 21 by the Lorentz-force.

Furthermore, the load current I flowing through the bridge contact 16 and the first arm 73 of the second terminal contact 18 generates a high magnetic field at the place of the second arc 24. Thus, the second arc 24 is driven into the second arc extinguishing device 22. A further first and a further second arc inside the second chamber 46 are driven into the further first and second arc extinguishing device 21', 22'.

Figure 2F:
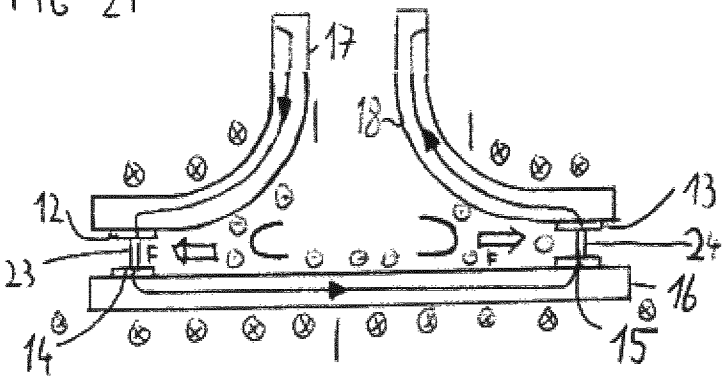
Figure 2G:
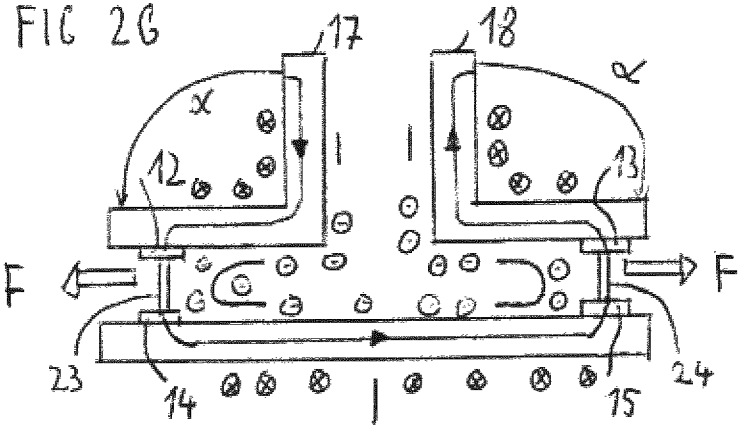
Figure 2D:
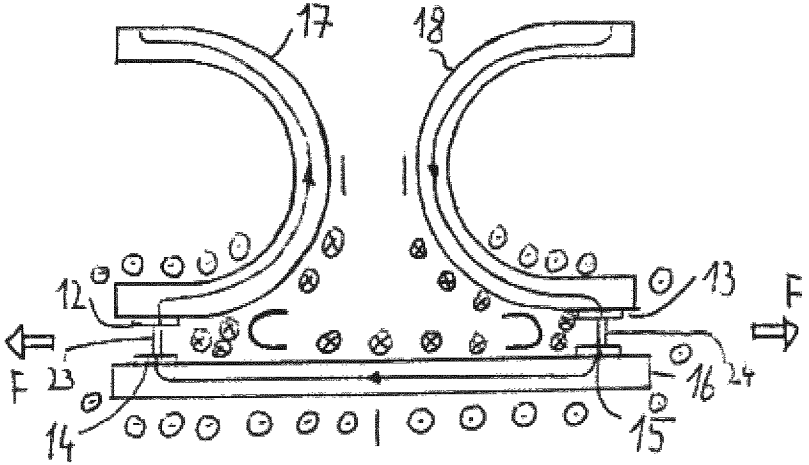

FIG. 2D shows the cross-section shown in FIGS. 2B and 2C in the switched-off state with the load current I flowing in the opposite direction. Also for a load current I flowing in the opposite direction, the force F drives the first arc 23 into the direction of the first arc extinguishing device 21 and the second arc 24 in the direction of the second arc extinguishing device 22. Advantageously, this effect is independent of the direction of the load current I.

Figure 2E:
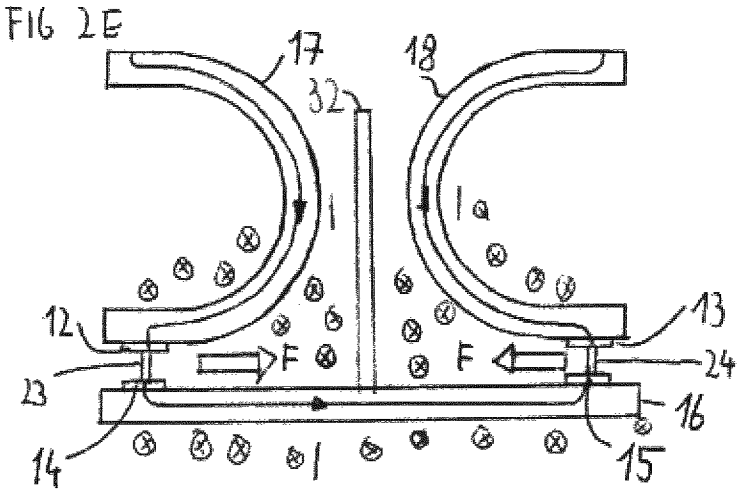

FIG. 2E shows the cross-section of FIGS. 2B to 2D in the case of a low value of the load current I. In case of a low value of the load current I such as in case of a nominal circuit or less, the magnetic field generated by the load current I is lower than a magnetic field generated by the permanent magnet system 35. As illustrated in FIG. 2E, the first and the second arc 23, 24 are driven into the barrier 32. The barrier 32 is configured to prevent a combination of the first and the second arc 23, 24 into a common arc directly between the first and the second terminal contact 17, 18. This effect depends on the direction of the load current I. Thus, in case of the load current I flowing into the opposite direction, the first and the second arc 23, 24 are driven into the first and the second arc extinguishing device 21, 22 (not shown in FIG. 2E). Here the force F and the movement of the two arcs 23, 24 depend on the direction of the load current I and on the direction of the magnetic field.

Thus, the first arc 23 is driven into the first arc extinguishing device 21 or towards the barrier 32. Also, the second arc 24 is driven into the second arc extinguishing device 22 or the barrier 32. Thus, either both arcs are driven into the two arc extinguishing devices 21, 22 or are both driven to the barrier 32.

The first and the second switching chamber 45, 46 are configured such that the two arcs inside the second switching chamber 46 are driven into the further arc extinguishing devices 21', 22', when the two arcs inside the first switching chamber 45 are driven into the barrier 32. Correspondingly, the first and the second switching chamber 45, 46 are configured that the two arcs inside the second switching chamber 46 are driven into the further barrier 32', when the two arcs inside the first switching chamber 45 are driven into the arc extinguishing devices 21, 22.

As shown in FIG. 1, the direction of the magnetic field generated by the permanent magnet system 35 is equal to the direction of the magnetic field generated by the further permanent magnet system 35'. Since a current direction in the first arc 23 is opposite to a current direction in the further first arc, either the first arc 23 or the further first arc 23 is driven to one of the arc extinguishing devices 21, 21'. Thus, the load current I is successfully interrupted. This is valid for the load current I being smaller than the nominal value.

Thus, the four arcs in the first and the second switching chamber 45, 46 are extinguished for low values of the load current I and also for high values of the load current I such as e.g. in the case of a short-circuit.

FIG. 2F shows an alternative example of the switching device 10 which is a further development of the above shown examples. The first terminal contact 17 is realized as a quarter of a circular line. Thus, the load current I has a U-formed path flowing through the first terminal contact 17, the first fixed contact 12, the first movable contact 14 and the contact bridge 16, such as shown in FIGS. 1, 2B to 2E. The second terminal contact 18 is realized such as the first terminal contact 17.

The load current I that flows through the first terminal contact 17 in the switched-on state has a path of a quarter of a circular line. The blowout field loop can be achieved also with other examples of the first and the second terminal contact 17, 18. Thus, in general, the load current I that flows through the first terminal contact 17 in the switched-on state may have a path between an eighth and three-quarter of a circular line or may have a path between a quarter and an half of a circular line.

The path of the load current I that flows through the first terminal contact 17 first extends in a first direction and then in a second direction which has an angle $\alpha$ of 90 degrees to the first direction. In general, the first direction may have an angle $\alpha$ of at least 45 degrees to the first direction.

FIG. 2G shows an alternative example of the switching device 10 which is a further development of the above shown examples. The first terminal contact 17 is realized as an angle piece. The first terminal contact 17 may have an L-form (capital letter L-form). The first arm 70 of the terminal contact 17 is parallel or approximately parallel to the contact bridge 16. The path of the load current I that flows through the first terminal contact 17 first extends in a first direction and then in a second direction which has an angle $\alpha$ to the first direction. The second arm 71 of the terminal contact 17 has the angle $\alpha$ with the first arm 70 of the terminal contact 17. The angle $\alpha$ may be out of a range between 30 to 150°. The angle $\alpha$ may be out of a range between 60 to 100°. The angle $\alpha$ may be, for example, 90°. The first arm 70 may have a short length. The first arm 70 may be configured to provide an area only for the first fixed contact 12. The second terminal contact 18 is realized such as the first terminal contact 17.

Figure 2I:
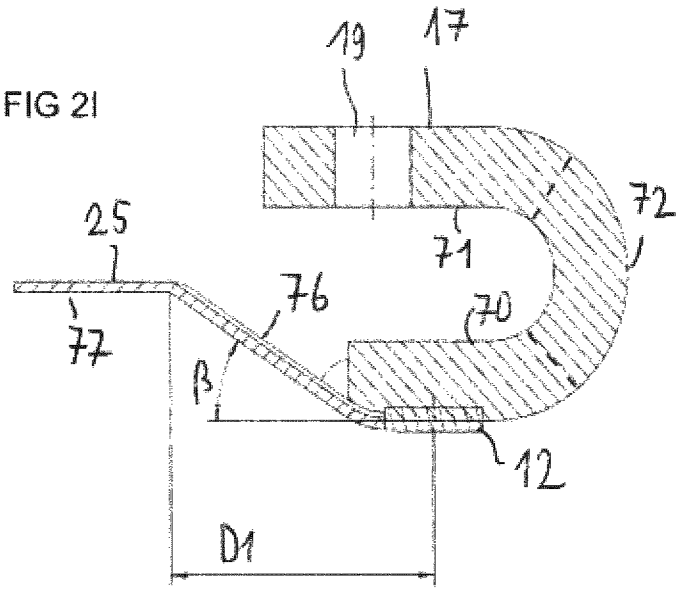
Figure 2H:
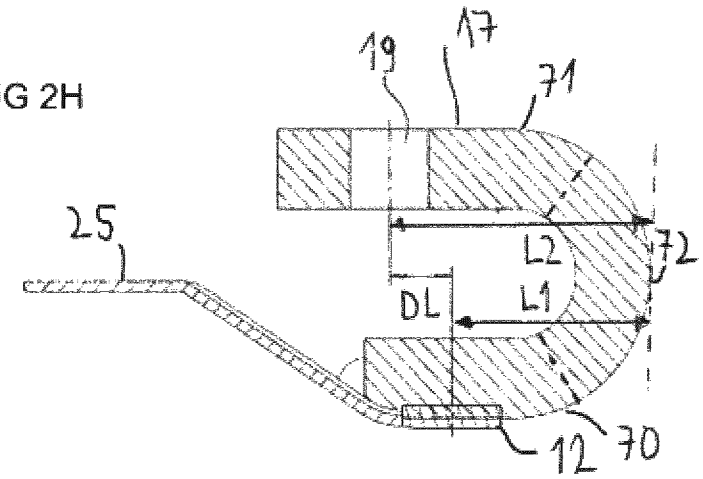

FIG. 2H shows an example of the first terminal contact 17 which is a further development of the above shown examples. The first terminal contact 17 has a U-form. The first terminal contact 17 has a first length L1 between a middle of the first fixed contact 12 and a bottom of the U-form. The bottom is the vertex of the U-form. The first terminal contact 17 has a second length L2 between a middle of a terminal connection hole 19 and the bottom of the U-form. The amount of the difference DL between the first and the second length L1, L2 may be less than 20 mm or 10 mm or 8 mm. In an example, the difference DL may be 5 mm. The second length L2 is larger than the first length L1. A bus connection line, bolt, pin or screw may be inserted into the terminal connection hole 19.

Alternatively, the first length L1 may be larger than the second length L2.

FIG. 2I shows an example of the first terminal contact 17 which is a further development of the above shown examples. The first arc runner 25 has a first part 76 attached to the first terminal contact 17. The first arc runner 25 has a second part 77 attached to the first part 76. The first arc extinguishing device 21 may be fixed to the second part 77. A main surface of the first terminal contact 17 has a first angle $\beta$ with respect to the first part 76 of the first arc runner 25. A main surface of the first arm 70 obtains the first angle $\beta$ with respect to the first part 76 of the first arc runner 25. A main direction of the first arm 70 has the first angle $\beta$ with respect to the first part 76 of the first arc runner 25. The first angle $\beta$ may be between 13 degrees and 53 degrees or may be between 23 degrees and 43 degrees. In an example, the first angle $\theta$ may obtain 33 degrees.

The middle of the first fixed contact 12 has a first distance D1 to the end of the first part 76 of the first arc runner 25 measured parallel to the main surface of the first terminal contact 17 or the main direction of the first arm 70. The length of the first part 76 is approximately D1/cos $\beta$. The second terminal contact 18 is realized such as the first terminal contact 17. The first distance D1 may be between 12 mm and 42 mm or may be between 17 mm and 32 mm. In an example, the first distance D1 may obtain 22 mm.

Figure 2J:
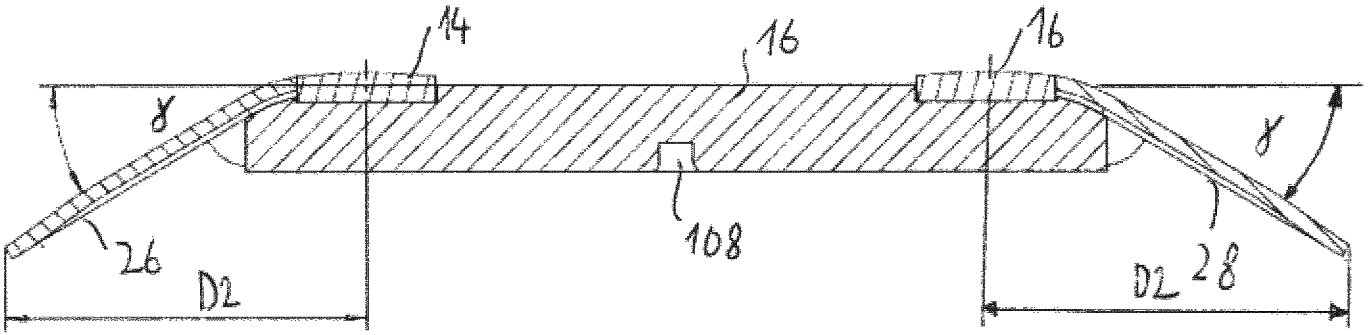

FIG. 2J shows an example of the contact bridge 16 which is a further development of the above shown examples. The second arc runner 26 is attached to the contact bridge 16. A main surface of the contact bridge 16 has a second angle $\gamma$ with respect to the second arc runner 26. A main surface of the first movable contact 14 obtains the second angle $\gamma$ with respect to the second arc runner 26. A main direction of the contact bridge 16 has the second angle $\gamma$ with respect to the second arc runner 26. The second angle $\gamma$ may be equal or approximately equal to the first angle $\beta$. A difference between the second angle $\gamma$ and the first angle $\theta$ may be less than 12 degrees, 6 degrees or 3 degrees. In an example, the second angle $\gamma$ may obtain 31 degrees.

The middle of the first movable contact 14 has a second distance D2 to the end of the second arc runner 26 measured parallel to the main surface of the contact bridge 16 or the main direction of the contact bridge 16. The length of the second arc runner 26 is approximately D2/cos $\gamma$. The second movable contact 16 is realized such as the first movable contact 14. The first distance D1 may be equal or approximately equal to the second distance D2. A difference between the first distance D1 and the second distance D2 may be less than 8 mm, 6 mm or 2 mm. In an example, the second distance D2 may obtain 21 mm.

Figure 2K:
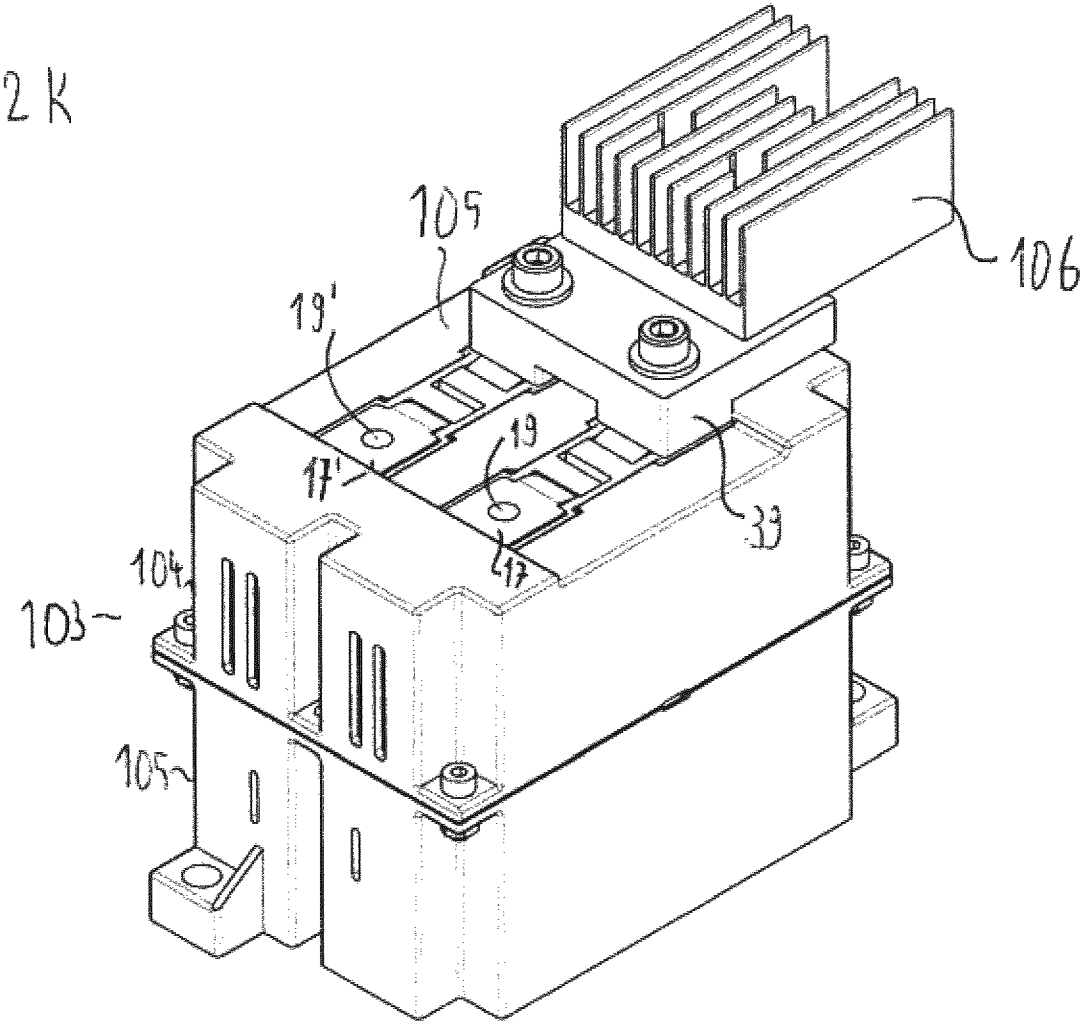

FIG. 2K shows an alternative example of the switching device 10 which is a further development of the above shown examples. The switching device 10 comprises a cover 103. The cover 103 comprises a first and a second part 104, 105. The first and the further first terminal contact 17, 17' flush with the cover 103. The first and the further first terminal contact 17, 17' do not extend beyond the cover 103. The first and the further first terminal contact 17, 17' are arranged in a recess 105 of the cover 103. The first and the further first terminal contact 17, 17' provide a flat surface. The terminal connecting bridge 39 is realized outside of the cover 103. A heat sink 106 is connected to the terminal connecting bridge 39. The heat sink 106 is configured to dissipate the heat generated by the load current I having nominal current value. The heat sink 106 may be made of aluminum, such as anodized aluminum. Thus, the terminal contacts 17, 17', 18, 18' are implemented in a space saving manner.

Figure 3:
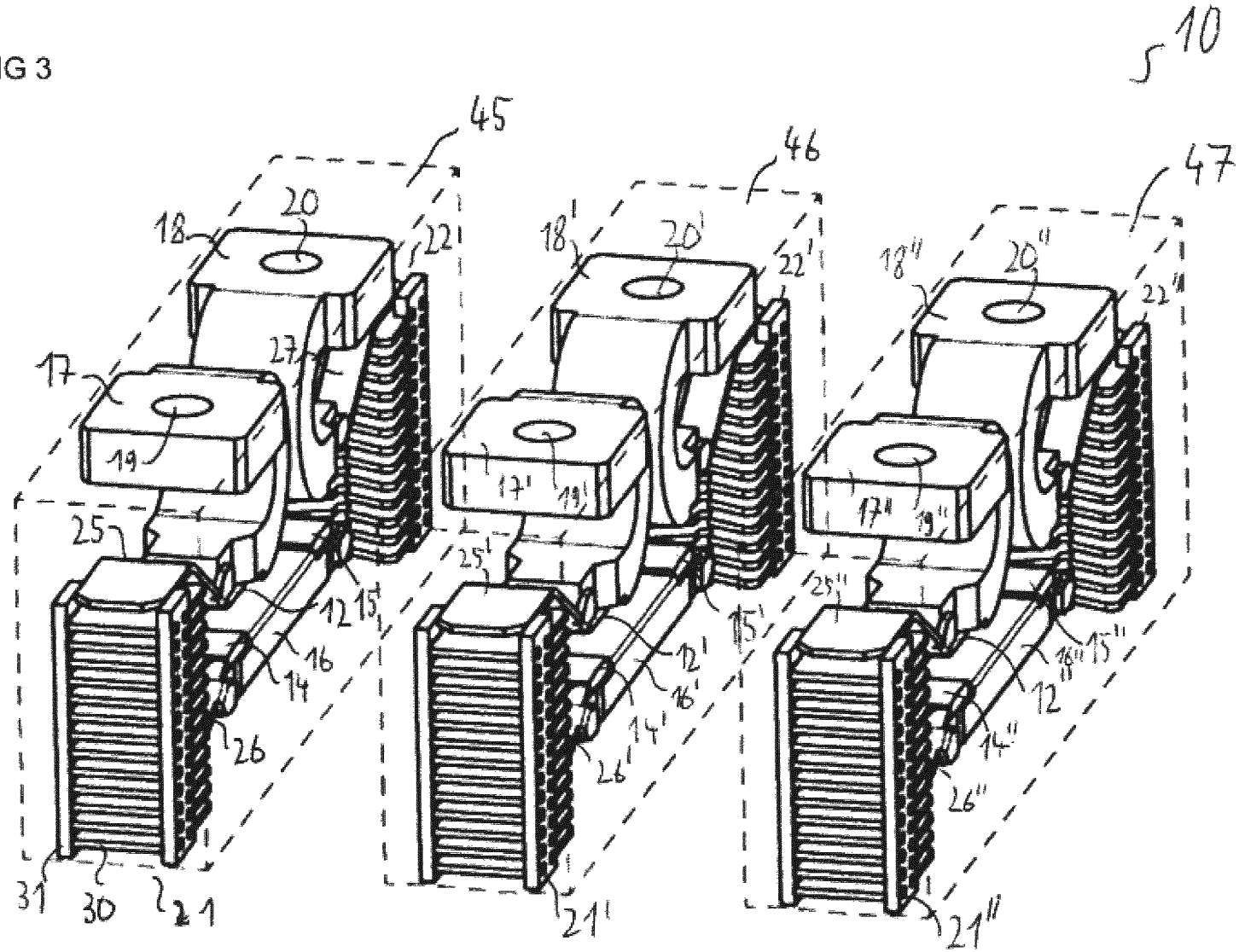
FIG. 3 shows a further example of a switching device.

FIG. 3 shows an example of the switching device 10 which is a further development of the above-shown examples. In FIG. 3, another view of the switching device 10 of FIG. 1 is shown. FIG. 3 only shows current carrying and arc extinguishing parts. In FIG. 3, the switching device 10 is realized as a multipole DC switching device with modular switching chambers. The switching device 10 comprises a third switching chamber 47. In general, the switching device 10 may comprise two chambers 45, 46 as shown in FIG. 1, three chambers 45 to 47 as shown in FIG. 3, more than three chambers or only one chamber. A switching chamber may be abbreviated chamber.

The third chamber 47 is realized such as the first chamber 45. Thus, the switching device 10 comprises an additional contact bridge 16", an additional first and second terminal contact 17", 18", an additional first and second fixed contact 12", 13" and an additional first and second movable contact 14", 15". The switching device 10 comprises additional first and second arc extinguishing devices 21", 22" and arc runners 25" to 28". The switching device 10 comprises an additional permanent magnet system 35" having an additional permanent magnet 36" and an additional first and second pole plate 37", 38". The additional contact bridge 16", the additional first and second terminal contact 17", 18" etc. are part of the third switching chamber 47.

The terminal connecting bridge 39, shown in FIG. 1, is omitted. Thus, the switching device 10 is configured for switching of three independent poles. In case the direction of the load currents I of the three poles is known, one chamber for each pole is sufficient for extinguishing the arcs of each pole.

In an alternative embodiment, the switching device 10 may comprise the terminal connecting bridge 39 connecting the second terminal contact 18 to the further second terminal contact 18'. The switching device 10 may comprise an additional connecting bridge. The further first terminal contact 17' may be connected by an additional terminal connecting bridge to the additional first terminal contact 17". Thus, the three switching chambers 45 to 47 are connected in series. The contact bridge 16, the further contact bridge 16' and the additional contact bridge 16" are connected in series. The magnetic drive assembly 40 moves the contact bridge 16, the further contact bridge 16' and the additional contact bridge 16" in parallel. Thus, at a transition from a switched-on state to a switched-off state of the switching device 10, six arcs may be generated. Therefore, a voltage across one of the six arcs is only a portion of the overall voltage between the first terminal contact 17 and the additional second terminal contact 18". The series connection of the chambers 45 to 47 or the series connection of the contact bridges 16, 16', 16" allows to switch higher voltages.

A parallel connection of the chambers 45 to 47 or a parallel connection of the contact bridges 16, 16', 16" allows higher currents to be switched. The load current I flows through two contact bridges 16, 16' as shown in FIG. 1, three contact bridges 16, 16', 16" as shown in FIG. 3, more than three contact bridges or only one contact bridge.

The series connection of the chambers 45 to 47 or the parallel connection of the chambers 45 to 47 can be performed e.g. after fabrication of the switching device 10 such as e.g. inside a factory that installs the switching device 10 (e.g. in an electro vehicle). The series connection of the contact bridges 16, 16', 16" or the parallel connection of the contact bridges 16, 16', 16" can be performed e.g. after fabrication of the switching device 10.

As shown in FIG. 3, in the switching device 10, component assemblies are modularly used. Several switching chambers 45 to 47 can be configured as switching devices with different characteristics in different manners. A DC switching device 10 with an improved short-circuit performance, for example for even higher nominal voltages, can be realized using an electrical series arrangement of several switching chambers 45 to 47, wherein the movable contact bridges 16, 16', 16" are operated by a common magnet drive assembly 40 with appropriate magnet force. A short-circuit tolerant DC switching device 10 can be realized for several current paths which are independent by omitting the terminal connection bridges 39. In FIG. 3, a DC switching arrangement for three different current paths is shown.

The contact bridge, arc extinguishing device and components of the magnet drive can be used for the fabrication of the switching device 10 as shown here but also for other switching devices.

The switching device 10 can be realized as a remote control switching device or remotely controlled switching device. The switching device 10 is configured to conduct and switch high load currents having high DC voltages. The switching device 10 is configured for a high number of switching events. The switching device 10 is configured to safely switch off short currents higher than 1 kA or higher than 10 kA or higher than 20 kA. The switching device 10 is configured to switch off load currents at voltages higher than 500 V or higher than 1000 V.

The switching device 10 is configured to safely control a short-circuit current without the use of a fuse. In the case of switching of high short-circuit currents, quick movement of the energy-rich arcs 23, 24 from the switching contacts 12 to 15 by a magnetic blowout field and a quick extinguishing in an arc extinguishing device 21, 22 are performed. A permanent magnet system 35 is usually configured for the switching of DC nominal currents. However, these permanent magnet system 35 are typically not implemented for the realization of short switching-off durations in the case of a short-circuit. The magnetic field is increased by a high factor by forming the geometry of the contact bridge 16, the first and the second terminal contact 17, 18 and optionally also other parts to a so-called magnetic blowout field loop. This magnetic field is generated in a short-circuit case and has an effect on the arcs 23, 24.

As shown in FIG. 1, the first and the second terminal contact 17, 18 comprises a massive loop in a U-form, wherein the first and the second fixed contact 12, 13 are arranged at the outer ends of the massive loop. Short bolts made of copper going through the cover 103 or housing of the switching device 10 are directly connected to the massive loop inside of the switching chambers 45, 46. When opening the fixed and movable contacts 12 to 15 in the case of a short-circuit, a strong magnetic force is generated by the dynamic field of the current loop which has an effect on the two generated arcs 23, 24. The two arcs 23, 24 are driven via the arc runners 25 to 28 that may be connected e.g. to the ends of the contact bridge 16 into the direction of the two arc extinguishing devices 21, 22 independent from the direction of the load current I.

In a short-circuit case the two arcs 23, 24 are separated in several partial arcs when running in the arc extinguishing devices 21, 22 caused by the dynamic blow field effect. The voltages of the partial arcs are a function of the number of the splitter plates 30. For each arc extinguishing device 21, 22 the voltages of the partial arcs are summed to a total voltage ULK. The total voltage across the complete switching chamber 45, 46 obtains the value of 2·ULK corresponding to the Kirchhoff mesh rule. When this total voltage, or alternatively also a voltage across a single arc extinguishing device 21, 22, is larger than the driving voltage, the arc 23, 24 is extinguished and the load current I is interrupted.

Advantageously, the switching device 10 comprises the second switching chamber 46 with an identical structure to separate currents of particularly high voltages. The second switching chamber 46 is electrically connected in series to the first switching chamber 45. The further contact bridge 16' of the second switching chamber 46 is synchronized with the contact bridge 16 of the first switching chamber 45 via the magnetic drive assembly 40. The serial coupling of the two switching chambers 45, 46 is realized via conducting connections with sufficient cross-section between the two terminal contacts 18, 18' of the two switching chambers 45, 46 that are arranged in the vicinity. In the case of a short-circuit, four arcs 23, 24 are formed which are each driven into an arc distinguishing device 21, 22, 21', 22' by the dynamic blowout force F. The total arc voltage of this switching device 10 is doubled and amounts to four times ULK thus increasing the ability for extinguishing arcs 23, 24.

The switching device 10 with two serially coupled identical switching chambers 45, 46 has another behavior when switching DC lower currents up to smaller overcurrents currents. In this case the magnetic field generated from the effective permanent magnet systems 35, 35' having permanent magnets 36, 36' in the two switching chambers 45, 46 dominates. The permanent magnet systems 35, 35' are oriented in such a way that the two arcs in one of the two switching chambers 45, 46 are driven via the runners 25 to 28 in the direction of the two arc extinguishing devices 21, 22, 21', 22' depending on the direction of the load current I, wherein the two arcs of the other switching chamber 45, 46 are moving in the opposite direction to each other.

An arc barrier or barrier 32 is arranged in the middle of the contact bridge 16. The barrier 32 is realized as a plate. The barrier 32 is fixed in the direction of the switching movement. The barrier 32 is realized by a temperature-insensitive isolating material. Thus, the barrier 32 is configured to inhibit a short-circuit of the two arcs 23, 24. The barrier 32 is configured such that the contact bridge 16 is mounted in the middle of the barrier 32.

The contact spring 44 is also inserted therein. The pin 102 provides safe guiding and the contact spring 44 provides the adequate contact force of the contact bridge 16 during the switching procedures using a guiding part with a fixating means. The guiding part is arranged between one side of the contact spring 44 and the contact bridge 16. Moreover, the contact spring 44 provides the necessary contacting force in the case of switching-on procedure. The barrier 32 is coupled in the direction of the magnetic drive assembly 40 via the contact bridge carrier 29 of the contact bridge 16 to the armature 43. In the case of a regular switching-off procedure, the contact bridge 16 moves together with the barrier 32 in the direction of the switching-off position. An arc going in the direction of the middle of the contact bridge 16 cannot form a base point on the other side of the barrier 32 due to the force fit connection and is prevented from a further movement in the direction of the second arc 24. Thus, a short-circuit of the two arcs 23, 24 is inhibited.

The situation in case of an overcurrent or a short-circuit with a comparably low short-circuit power is different. In this case, in the phase immediately after opening of the contacts, first the dynamic magnetic field generated by the terminal contacts 17, 18 and the contact bridge 16 dominates such that arcs 24, 24 of the two switching chambers 45, 46 move in the direction of the corresponding arc extinguishing device 21, 22, 21', 22'. The level of the load current I that flows through the contact bridge 16 is reduced by the reduction of the arc energy that is realized by the entrance of the arcs in the arc extinguishing devices 21, 22, 21', 22'. Correspondingly, the level of the dynamic blow field is reduced. This results in an increase of the influence of the permanent magnetic field on the arcs 23, 24. This may result in one switching chamber 45, 46 that in a phase of decreasing levels of the load current I, the direction of movement of the two arcs 23, 24 which are moving in the direction of the arc extinguishing devices 21, 22, 21', 22' at the start is reversed and the arcs 23, 24 are moving in the direction towards each other and thus in the direction of the barrier 32.

A short-circuit of the two arcs 23, 24 can be effectively inhibited by the barrier 32 also in the case of a short-circuit current that is higher than the dynamic lift-off limit of the switching device 10. In this case the opening movement of the contact bridge 16 generated by the dynamic Lorentz force realizes a two-dimensional pressure of the back side of the contact bridge 16 on the barrier 32 such that a movement of an arc 23, 24 across the barrier 32 is inhibited during the lift-off phase also on a back side of the contact bridge 16 in that the barrier 32 and the contact bridge carrier 29 have freedom of movement in this direction and independent of the position of the bridge 101.

The barrier 32 can be implemented such that the barrier 32 is an extension or elongation of the contact bridge carrier 29 in the direction of the switching movement. The contact bridge carrier 29 and the barrier 32 can be realized as one piece or one part. The switching device 10 is constructively implemented such that a two-dimensional coupling of the complete range of the contact bridge 16 is performed to an isolating material of the barrier 32 in the case of an opening movement of the contact bridge 16, in the case of nominal currents and in the case of a dynamic lift-off generated by a short current.

According to a typical application of the switching device 10, the switching device 10 may have to withstand only a limited number of switching events at higher currents or at short-circuit currents. Thus, the ability for isolation of the barrier 32 is sufficient at an appropriately chosen isolating material for the limited number of switching events over the nominal current.

The switching device 10 has a high short-circuit switching performance. The switching device 10 is realized in a compact form which is suitable for the use in electric vehicles. In the case of conventional switching devices, the magnet core 42 is arranged at the bottom of the switching chamber 45 and is rigidly coupled to the switching chamber 45. The moving magnet armature 43 may be completely arranged directly above the magnet core 42 and/or submerged in the magnet core 42. The contact bridge carrier 29 carries the movable contact bridge 16. The contact bridge carrier 29 is made from an isolating material. The bridge 101 is rigidly coupled to the armature 43 on the side of the armature 43 which is directed to the magnet core 42.

In the magnet drive as shown in FIGS. 1 and 2A, the armature 43 has a T-form. The movable armature 43 is arranged at the bottom of an enclosure. The magnet core 42 has a C-form. The magnet core 42 is arranged directly above in the direction of the switching chamber 45 and is rigidly coupled to the enclosure of the drive. The contact bridge carrier 29 is not completely fixed out of the magnet drive at the upper side of the armature 43 which faces the switching chamber 45. The connection to the armature 43 is achieved along the outer sides of the longitudinal arm of the armature 43. Thus, the lower part is dropped on the level of the magnet core 42 such that the complete arrangement of the magnet drive uses less area than a conventional magnet drive, resulting in a very compact realization of the switching device 10 in the direction of the switching.

The switching device 10 is realized as a remote control switching device. The switching device 10 is configured for conducting and switching of bidirectional load currents I and bidirectional over-currents. The load currents I may be higher than 100 A. The overcurrents may be e.g. short-circuit currents. The switching device 10 is realized for a high number of switching events under load, wherein the number may be higher than 50,000. Alternatively, the number may be higher than 100,000 or 500,000.

The switching device 10 is fabricated in a space-effective manner. The switching device 10 comprises terminal contacts 17, 18 evenly arranged with a front side of the cover 103, which head into the switching chamber 45 and which are arranged in a U-form inside the switching chamber 45. Moreover, the switching device 10 comprises a movable contact bridge 16 arranged below the terminal contacts 17, 18. Additionally, the switching device 10 comprises an efficient arc driver and extinguishing arrangement having arc runners 25 to 28 at the end of the fixed and the movable contacts 12 to 15 and arc extinguishing devices 21, 22 attached to these parts. The arc extinguishing devices 21, 22 are realized as deionization extinguishing device, abbreviated as Deion extinguishing device. Additionally, the switching device 10 comprises a U-form permanent magnetic arc driver arrangement enclosing said arrangement for generation of an efficient dynamic magnetic blowout field in the short-circuit case as well as for a quick arc movement and extinguishing in the case of a nominal current and a short-circuit current.

The contact bridge 16 and the first and second terminal contacts 17, 18 have a short length for limiting the current heat when carrying high nominal currents.

The switching device 10 comprises the barrier 32 made of an isolating material enclosing the movable contact bridge 16 at the middle of the contact bridge 16 for preventing short-circuits of two arcs 23, 24.

The contact bridge carrier 29 for the contact bridge 16 is guided parallel to the armature 43 and is realized in space-saving manner.

Two, or more than two, identical or nearly identical switching chambers 45 to 47 are arranged in a parallel arrangement in a modular concept which are either connected in series to each other for switching DC currents with a high nominal voltage or which are configured for the parallel conducting and switching of several DC load currents I.

The switching device 10 realizes a very short switching-off time for quickly switching-off short-circuit currents using, for example, a conventional electromagnetic drive with an electronic fast de-excitation or fast discharge. A time between the signal for switched-off up to the complete opening of the contacts may be less than 5 milliseconds. Alternatively, the time is less than 2.5 milliseconds. Alternatively, the time is less than 1 millisecond. The electromagnetic drive has a reduced mass. The armature 43 of this contact bridge 16 and the contact bridge carrier 29 contribute to the mass. The switching device 10 shows a high contact pressure force and a high rejection force. The magnet circuit realizes a configuration that has a low eddy current by using bundled sheet metal and is therefore suitable for rapid remagnetization. The quick field discharge can be realized without an external auxiliary energy source.

The switching device 10 may be realized as an electronic control switching device. The switching device 10 may comprise an integrated Hall sensor arrangement or another current sensor for a quick switching-off of the coil current in the case of a high overcurrent and of short-circuit currents. The switching device 10 may have an external signal input for remotely controlled quick switch-off in the case of an external emergency event. The switching device 10 may comprise an auxiliary contact arrangement with a complementary mirror contact function to the main contacts which carry and switch the load current for the permanent control of the switching function.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

10 switching device

12, 12', 12" first fixed contact

13, 13', 13" second fixed contact
14, 14', 14" first movable contact
15, 15', 15" second movable contact
16, 16', 16" contact bridge
17, 17', 17" first terminal contact
18, 18', 18" second terminal contact
19, 20, 19' terminal connection hole
21, 21', 21" first arc extinguishing device
22, 22', 22" second arc extinguishing device
23 first arc
24 second arc
25 to 28 arc runner
29 contact bridge carrier
30 splitter plate
31 core
32 barrier
35, 35', 35" permanent magnet system
36, 36', 36" permanent magnet
37, 37', 37" first pole plate
38, 38', 38" second pole plate
39 terminal connecting bridge
40 magnetic drive assembly
41 coil
42 magnet core
43 armature
44 contact spring
45 first switching chamber
46 second switching chamber
47 third switching chamber
70, 73 first arm
71, 74 second arm
72, 75 connecting part
101 bridge
102 pin
103 cover
104, 105 part
105 recess
106 heat sink
108 notch
D1, D2 distance
F force
I load current
L1, L2 length
α, β, γ angle

The invention claimed is:

1. A switching device, comprising:
a first terminal contact;
a first fixed contact arranged at the first terminal contact;
a contact bridge;
a contact bridge carrier arranged at the contact bridge and comprising a barrier;
a first movable contact arranged at the contact bridge;
a second terminal contact;
a second fixed contact arranged at the second terminal contact;
a second movable contact arranged at the contact bridge; and
a magnetic drive assembly comprising a coil and an armature, the armature being coupled to the contact bridge,
wherein the first fixed contact is in contact with the first movable contact in a switched-on state of the switching device,
wherein the first fixed contact is free of contact with the first movable contact in a switched-off state of the switching device,
wherein the second fixed contact is in contact with the second movable contact in the switched-on state of the switching device,
wherein the second fixed contact is free of contact with the second movable contact in the switched-off state of the switching device,
wherein the first terminal contact has a bended form such that a load current that flows through the first terminal contact, the first fixed contact, the first movable contact, and the contact bridge has a U-formed path in the switched-on state,
wherein the barrier is arranged between the first terminal contact and the second terminal contact and is free of contact with the first terminal contact and the second terminal contact, the barrier being configured to prevent an arc from forming between the first terminal contact and the second terminal contact, and
wherein the switching device is a circuit breaker.

2. The switching device according to claim 1, wherein the first terminal contact forms a first arm of the U-formed path,
wherein the contact bridge forms a second arm of the U-formed path, and
wherein the first movable contact and the first fixed contact are part of the coupling of the first arm to the second arm.

3. The switching device according to claim 1, wherein a load current that flows through the first terminal contact in the switched-on state has a path between an eighth and three-quarters of a circular line.

4. The switching device according to claim 1, further comprising:
a cover,
wherein the first terminal contact is flush with the cover.

5. The switching device according to claim 1, wherein the first terminal contact has an U-form,
wherein the first terminal contact has a first length between a middle of the first fixed contact and a bottom of the U-form and a second length between a middle of a terminal connection hole of the first terminal contact and the bottom of the U-form, and
wherein an amount of difference between the first length and the second length is less than 20 mm.

6. The switching device according to claim 1, wherein the magnetic drive assembly comprises a magnet core which holds the coil, and
wherein the contact bridge is configured to move away from the magnet core at a transition from the switched-off state to the switched-on state.

7. The switching device according to claim 6, wherein the magnet core surrounds the coil, and wherein the armature is configured to extend from an axial centerline of the magnetic drive assembly at least as far as an outer extent of the magnet core.

8. The switching device according to claim 1, wherein a path of a load current that flows through the first terminal contact, the first fixed contact, the first movable contact, and the contact bridge in the switched-on state extends or approximately extends in a first plane, and
wherein a movement of the contact bridge between the switched-on state and the switched-off state has a direction that is parallel to the first plane.

9. The switching device according to claim 1, further comprising:
a first arc runner arranged at the first terminal contact near the first fixed contact; and
a second arc runner arranged at the contact bridge near the first movable contact.

10. The switching device according to claim 9, further comprising:

a first arc extinguishing device configured to extinguish a first arc originating between the first fixed contact and the first movable contact, wherein the first arc extinguishing device is connected to the first terminal contact and/or the first arc runner.

11. The switching device according to claim 1, wherein a first arc is generated between the first fixed contact and the first movable contact at a transition between the switched-on state and the switched-off state, and wherein a load current that flows through the first terminal contact, the first fixed contact, the first arc, the first movable contact, and the contact bridge has a U-form.

12. The switching device according to claim 1, further comprising:

a further first terminal contact;

a further first fixed contact arranged at the further first terminal contact;

a further second terminal contact;

a further second fixed contact arranged at the further second terminal contact;

a further contact bridge; and a further first movable contact and a further second movable contact arranged at the further contact bridge.

13. The switching device according to claim 12, wherein the switching device is operable for: a separate circuit of the contact bridge and the further contact bridge; a series circuit of the contact bridge and the further contact bridge; and a parallel circuit of the contact bridge and the further contact bridge.

14. The switching device according to claim 1, wherein the contact bridge carrier and the barrier comprise an identical material.

15. The switching device according to claim 1, wherein the first terminal contact and the second terminal contact each have a single vertex at which the first terminal contact and the second terminal contact are closest to one another.

16. The switching device according to claim 15, wherein the barrier is arranged between the vertex of each of the first terminal contact and the second terminal contact irrespective of whether the switching device is in the switched-on state or the switched-off state.

17. The switching device according to claim 1, wherein the switching device is configured to safely switch off currents higher than 1 kA.

18. A switching device, comprising:

a first terminal contact;

a first fixed contact arranged at the first terminal contact;

a contact bridge;

a contact bridge carrier arranged at the contact bridge and comprising a barrier;

a first movable contact arranged at the contact bridge;

a second terminal contact;

a second fixed contact arranged at the second terminal contact;

a second movable contact arranged at the contact bridge; and a magnetic drive assembly comprising a coil and an armature, the armature being coupled to the contact bridge, wherein the first fixed contact is in contact with the first movable contact in a switched-on state of the switching device, wherein the first fixed contact is free of contact with the first movable contact in a switched-off state of the switching device, wherein the second fixed contact is in contact with the second movable contact in the switched-on state of the switching device, wherein the second fixed contact is free of contact with the second movable contact in the switched-off state of the switching device, wherein the first terminal contact has a bended form such that a load current that flows through the first terminal contact, the first fixed contact, the first movable contact, and the contact bridge has a U-formed path in the switched-on state, wherein the barrier is arranged between the first terminal contact and the second terminal contact, wherein the switching device is a circuit breaker, wherein the first terminal contact has an U-form, wherein the first terminal contact has a first length between a middle of the first fixed contact and a bottom of the U-form and a second length between a middle of a terminal connection hole of the first terminal contact and the bottom of the U-form, and wherein an amount of difference between the first length and the second length is less than 20 mm.

* * * * *